United States Patent [19]

Rorex

[11] 4,081,080

[45] Mar. 28, 1978

[54] DOCUMENT FILING ASSEMBLY

[75] Inventor: Robert L. Rorex, Ridgecrest, Calif.

[73] Assignee: Kole Enterprises, Inc., Miami, Fla.

[21] Appl. No.: 645,320

[22] Filed: Dec. 30, 1975

[51] Int. Cl.[2] ..... A47F 7/00; G09F 1/10

[52] U.S. Cl. ..... 211/55; 40/124.2

[58] Field of Search ..... 211/49, 50–57, 211/58, 59, 128; 40/124, 124.2, 124.4; 108/92, 96

[56] References Cited

U.S. PATENT DOCUMENTS

| | | | |
|---|---|---|---|
| 668,727 | 2/1901 | Chapman | 211/55 |
| 1,156,401 | 10/1915 | Hawley | 40/124.2 |
| 1,455,192 | 5/1923 | Dumont | 40/124.2 |
| 1,741,586 | 12/1929 | Russell et al. | 40/124.4 |
| 2,909,287 | 10/1959 | Galassi | 211/55 |
| 3,743,371 | 7/1973 | Sullivan | 211/49 D X |

*Primary Examiner*—Roy D. Frazier
*Assistant Examiner*—Terrell P. Lewis
*Attorney, Agent, or Firm*—Andrus, Sceales, Starke & Sawall

[57] ABSTRACT

A vertical wall support unit includes laterally spaced support members including interlocking means to receive thin box-like receptacles which are open at the top for storage of paper and the like. The thin receptacles are arranged in a vertical, stacked row in overlapping face-to-face relationship with releasable interlocking elements. The wall support unit is constructed with a wedge-shaped portion to tilt the receptacles outwardly and increase the visibility and accessibility of the open tops. Each receptacle in the row engages and is supported by the adjacent receptacle of the row to be held thereby in the desired outwardly tilted position.

5 Claims, 7 Drawing Figures

DOCUMENT FILING ASSEMBLY

BACKGROUND OF THE INVENTION

This invention relates to a wall rack for filing papers and similar relatively thin, single and multiple page units; for example, current insurance reports. Documents such as business records and other papers are commonly stored in folders in the drawers of steel filing cabinets. The cabinets take up floor space and it requires time and effort to open the drawers and search for a particular folder. Such storage cabinets have high utility for permanent records which must be accessible over relatively long periods of time, but there is need for a more convenient and time-saving system for storing certain current records for quick access; for example, for storing more or less current insurance reports.

SUMMARY OF THE INVENTION

The object of the invention is to save time and effort by providing a highly visible storage system that affords maximum accessibility to the stored documents and does not require opening and shutting of cabinet drawers. Another important object of the invention is to provide such a storage system that does not require the substantial floor space that is necessitated by conventional filing cabinets.

These objects are obtained by a wall storage means for box-like receptacles which are arranged in a vertical row in overlapping face-to-face relationship. For convenience and accessibility, the overlapping receptacles are tilted forward; for example, tilted approximately twenty degrees from vertical.

A further object of the invention is to provide such a wall storage system that may be readily expanded and contracted for storage capacity in accordance with particular demand. For this purpose, the number of receptacles in a row may be readily changed up to a full row. When even more capacity is required, one or more vertical rows of the receptacles may be added.

A still further object of the invention is to provide a construction for a storage wall rack of the character described that is both structurally efficient and economical in cost. In a particular, practical aspect of the invention, vertical support means are adapted for mounting on a vertical surface such as a wall and includes means to tilt the first receptacle supported thereon. Each receptacle includes interlocking means to similarly support another receptacle on the front wall with the open top in downwardly spaced relation.

In one embodiment of the invention, a sheet metal bracket fastens to a wall surface and serves to anchor support means in the form of a pair of spaced vertical bars which have vertical spaced recesses comprising inclined kerfs which seat corresponding lips or flanges at the bottom ends of the respective receptacles. Mounted on the upper ends of the pair of bars is a wedge-shaped spacer having a forward face that is tilted outward; for example, at an angle of approximately twenty degrees from vertical. The uppermost of the overlapping receptacles has a rearward lip or hook flange at its upper end which hooks onto the spacer to maintain the uppermost receptacle at the desired tilt. Each of the rest of the receptacles has a similar rearward lip or hook flange which hooks onto the next higher receptacle in the row. Thus, the upper ends of the receptacles are supported in tandem at the desired angle by the wedge-shaped spacer.

The receptacles may be formed of any suitable material with the releasable coupling portions integrally or separately formed and attached. Similarly, the wall support assembly may be conveniently formed of any suitable material with the several components as illustrated or with any suitable integral combination. The size of the receptacles may, of course, vary to accommodate various sized documents.

The features and advantages of the invention may be understood from the following detailed description together with the accompanying drawing.

BRIEF DESCRIPTION OF THE DRAWING

The drawing, furnished herewith, illustrates a preferred construction of the present invention in which the above advantages and features are clearly disclosed as well as others which will be readily understood from the following description of such illustrated embodiment.

In the drawing.

DESCRIPTION OF THE ILLUSTRATED EMBODIMENTS

Figure 1:
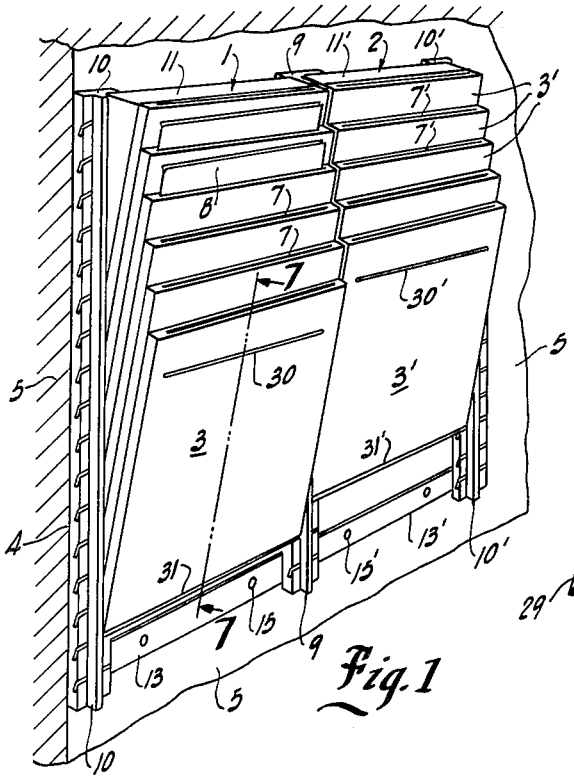
FIG. 1 is a perspective view of the one embodiment of the invention in which two rows of tilted receptacles are provided.

In FIG. 1, two vertical rows 1 and 2 of open top, thin, box-like receptacles 3 and 3' are mounted on an adjustable, vertical support means 4 in overlapping face-to-face relationship. The support means 4 is secured to a suitable, vertical wall 5 or otherwise mounted in the vertical position, for example, on a movable frame, truck or the like.

In the first illustrated embodiment, the two rows 1 and 2 are essentially duplicates and row 1 is described in detail with the corresponding elements of row 2 identified by corresponding primed numbers for simplicity and clarity of explanation. The several receptacles 3, and thus 3', are, in accordance with the present invention, specially constructed with interlocking releasable coupling means 6 between the adjoining surfaces such that each outer receptacle 3 is supported by an inner receptacle 3 and with the coupling means 6 permitting expansion and contraction of the number of receptacles in the assembly.

In a particularly unique and practical embodiment, each of the receptacles 3 is thus generally formed as a relatively thin, rectangular box-like member having an open top 7 for the insertion and removal of single sheet and/or multiple paged documents 8. The several receptacles 3 are mounted in abutting, vertically staggered relation and are angularly oriented with respect to the vertical supporting wall to locate the upper end forwardly of the lower end. This arrangement readily exposes the upper ends of the receptacles for manipulation of the documents 8. The vertical offsetting of the receptacles 3 also permits the extension of the documents 8 if desired upwardly through the open top at least partially without obstructing or interferring with the immediately adjacent receptacle. The combination of the vertical, staggering of the receptacle 3 and the angular orientation thereof provides particularly convenient and rapid use of the filing assembly. In addition the wall mounting, with means for expansion and contraction of the assembly, provides a compact and relatively inexpensive storage particularly adapted for more or less current documents.

Generally, in the illustrated embodiment of FIGS. 1–7, support means 4 includes a multiple part wall bracket assembly of a center common vertical bar 9 for rows 1 and 2 and outer vertical similar bar 10 and 10'. A separate, angular orienting unit 11 is secured between the bracket assembly and the uppermost receptacle 3 to establish the particular angular orientation of the several receptacles 3. The uppermost receptacle 3 is constructed like each of the other receptacles and releasably coupled to the angular orienting unit 11 by coupling means 12 similar to that effected between the several receptacles 3.

More particularly, in the embodiment of the invention shown in FIGS. 1–7, the three laterally spaced T-shaped bars 9, 10 and 10' are similarly constructed such that any bar can be located in any one of the three positions, and further provide direct lateral expansion for additional rows, as will be obvious from the subsequent description of the illustrated mounting of the receptacles 3 in row 1.

The three vertical bars are shown secured to vertical wall 5 in any suitable manner. In this embodiment of the invention the bars 9 and 10 are interconnected and anchored at their upper and lower ends to similar sheet metal brackets 13 of the construction shown in FIGS. 2 and 3. Each bracket 13 is a forwardly open channel-type having two spaced holes 14 to receive suitable screws 15 fastening the bracket to a wall 5 with the base portion 16 of the bracket lying against the wall 5. Each bracket 11 also has an inclined full-length upper wall flange 17 which projects upwardly from base portion 16 and a pair of vertical sidewall flanges 18 at the opposite ends of the base portion 16.

Figure 3:
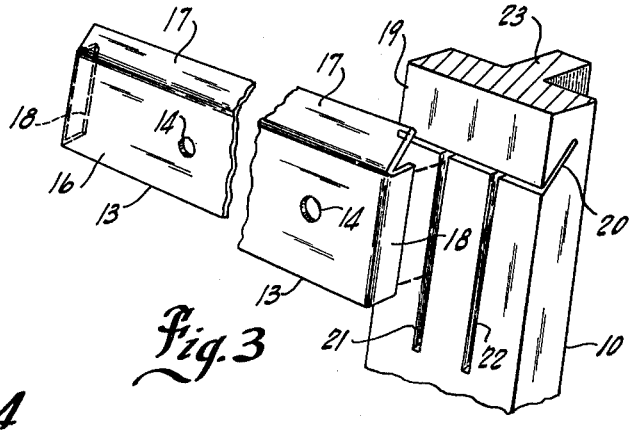
FIG. 3 is an enlarged fragmentary perspective view showing how a sheet metal bracket engages and supports one of the vertical bars.
Figure 5:
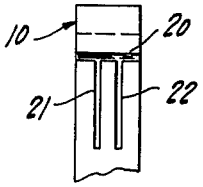
FIG. 5 is a fragmentary rear elevation of FIG. 2.
Figure 4:
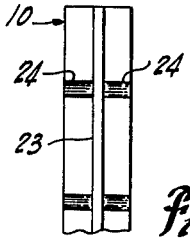
FIG. 4 is a fragmentary front elevation of FIG. 2.

Each bar 10 is a T-shaped element with the cross arm 19 being hung on brackets 13. The upper and lower ends, respectively, of the cross arm of each vertical bar 10 is provided on its rear side with an inclined slot or kerf 20 which extend upwardly at the angle of the inclined flange 17 of bracket 13 and a pair of vertical slots 21 and 22 that extend downward from the horizontal kerf. Each slot 21 and 22 is adapted to receive an end flange 18 of brackets 13. Thus, the inclined flanges 17 of two brackets 13, as shown in FIG. 3, may support the upper ends of the vertical bars 9 and 10, and the end flanges 18 mating with slots 21 and 22 of the two upper brackets 13 maintain predetermined spacing between the upper ends of the bars. In like manner, two lower brackets 13, shown in FIG. 1, engage the lower ends of the vertical bars 9 and 10 and end flanges 18 of the two lower brackets maintain the desired spacing of the lower ends of the vertical bars 9 and 10.

Each T-shaped vertical bar 10 has the stem 23 projecting forwardly in corresponding lateral parallel relation. The cross arm 19 is thus divided into a pair of support portions which is formed with a series of vertically spaced recesses in the form of inclined supporting kerfs 24 to support an orienting spacer 11 and the receptacles 3, as follows.

Figure 6:
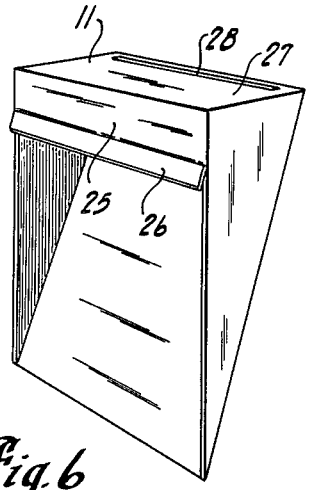
FIG. 6 is a perspective view of a triangular spacer which forms a part of the head or upper portion of each of the two rows.

A suitable hollow wedge-shaped spacer 11, which may be made of plastic, is mounted at the upper end of the vertical row 1 of receptacles 3 between the projecting stems 23 of bars 9 and 10 for the purpose of defining a front angularly oriented front wall which tilts the receptacles of the row, with the upper end spaced outwardly of the bottom end at the desired angle. As shown in FIG. 6, spacer 11 is shown largely open at its rear, being provided with a short upper back wall 25. The short wall 25 terminates in a downwardly inclined lip or hook flange 26, the opposite ends of which seat in a pair of kerfs 24 in the cross arms 19 of the vertical bars 9 and 10 to support the spacer 11. In FIG. 1, the hook flanges 26 of the spacer 11 seat in the kerfs 24 adjacent the top in each vertical row of kerfs to locate the top wall in the top plane of the bars for a pleasing appearance. It is to be noted that the stems 23 of the pair of vertical bars 9 and 10 provide a pair of lateral shoulders that confine the spacer 11 against lateral displacement, and as presently developed receptacles 3 in this embodiment.

Figure 2:
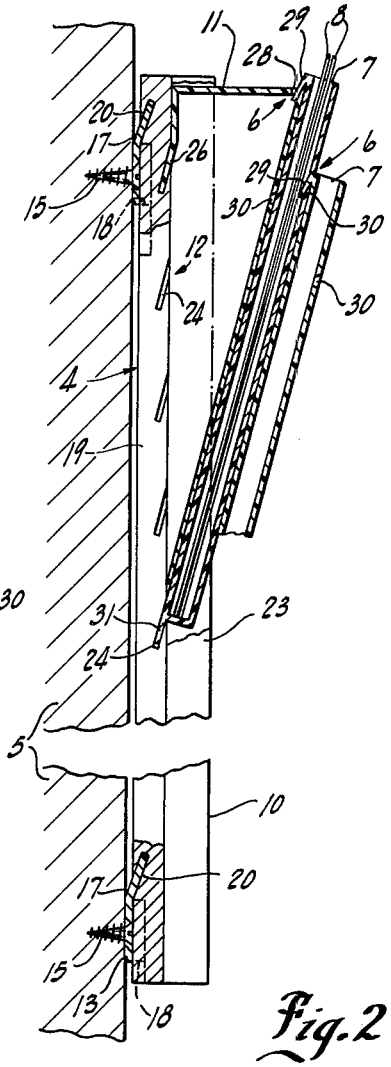
FIG. 2 is a fragmentary side elevation of a portion of the wall support unit of FIG. 1.

As shown in FIGS. 1, 2 and 6, the top wall 27 of hollow spacer 11 has a forward transverse slot 28 that is shaped and dimensioned for hook engagement by a rearward hook flange 29 of a paper receptacle 3.

Figure 7:
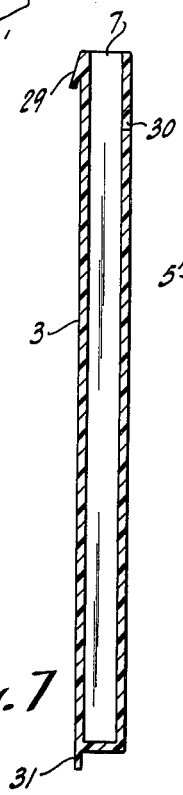
FIG. 7 is a vertical section of the receptacle as seen along the line 7—7 of FIG. 1 and more particularly illustrating some of the inner detail of construction.

The paper receptacles 3 are formed of a suitable material such as a thin-walled plastic construction and are of a generally rectangular construction with an open top for insertion and removal of various single and multiple page documents. As shown in FIGS. 2 and 7, each paper receptacle has a back wall with a rearwardly downwardly extending inclined flange or lip 29 which may be termed a hook flange at the upper end portion. As shown in FIGS. 1, 2 and 6, the front wall of the receptacle 3 has a transverse slot 30 near its upper end, the lower edge of the slot constituting what may be termed an upwardly directed portion of the paper receptacle that is adapted for hook engagement by a hook flange 29 of another receptacle, as shown in FIG. 2.

In FIGS. 1 and 2, the rear hook flange 29 of the uppermost paper receptacle 3 in row 1 is in hook engagement with the transverse slot 28 of the spacer 11 and rearward hook flange 29 of each of the remaining paper receptacles 3 in row 1 are in hook engagement with the transverse slot 30 of the next above paper receptacle in the row. Thus the upper ends of the paper receptacles 3 of a row are supported in tandem upon the spacer 11 at the top of the row, with the upper open end of each receptacle 3 below the upper end of the preceeding receptacle. Further, the flange 29 may fit reasonably snuggly within the slot 30 to provide lateral alignment of the receptacles 3 in a row.

As shown most clearly in FIGS. 1, 2 and 7, the paper receptacles 3 of the first embodiment each have a rearward bottom lip or flange 31 that is shaped and dimensioned to seat in the kerfs 24 of two of the vertical bars 9 and 10; the kerfs of the two vertical bars being arranged in aligned pairs for this purpose. This further locates and supports the bottom edge of each receptacle 3 as well as the spacer, in this embodiment, with the desired angular orientation of the receptacles.

Paper receptacles may be readily added to an incomplete vertical row until the vertical row is completed. Thus, to add a paper receptacle 10 to the left row 1 of paper receptacles in FIG. 1, it is a simple matter to seat the bottom flange 31 of the additional paper receptacle in the lowermost pair of kerfs 24 of the pair of support bars 12 and to insert the rearward hook flange 29 of the added receptacle 3 into the transverse slot 30 on the exposed front wall of the next above receptacle 3. It is also a simple matter to add a vertical bar 10 for the purpose of supporting an additional row of the paper receptacles. Thus, in FIG. 1 the addition of the third vertical bar 10' at the right makes it possible to add the second row 2 of the paper receptacles 3', employing the outer exposed side of the cross-arm of the common center bar 9 as the left edge support for the second spacer and the second row of receptacles 3.

The fact that each vertical bar 9 and 10 is divided in two halves, each of which has a series of the kerfs 24, makes it possible for each of the vertical bars to cooperate in the support of two adjacent rows of the paper receptacles. Thus, in FIG. 1 the central vertical bar 9 serves in effect as two bars to cooperate with the two outer vertical bars 10 and 10' to support the two rows 1 and paper receptacles 3 and 3'.

Thus, if it desired to add still another laterally located row, it is merely necessary to add an additional single vertical bar and top and bottom brackets secured to one of the end bars 10 or 10'.

The present invention thus provides a highly efficient and compact document storage system which may be readily sized to current requirements while providing convenient expansion for future needs.

Various modes of carrying out the invention are contemplated as being within the scope of the following claims, particularly pointing out and distinctly claiming the subject matter which is regarded as the invention.

I claim:

1. In a wall filing assembly for filing letter sized documents and the like, the combination of: a support means having wall attachment means for connecting the support means to a vertical wall, said support means including a locating means with a bottom end which is located immediately adjacent the vertical wall with the support means attached to the vertical wall, said locating means including a front wall extending upwardly and outwardly from said bottom end at an angle substantially less than 45° to the vertical wall and with an upper end spaced outwardly of the bottom end, a plurality of thin rectangular document receptacles each having a front wall and a back wall joined by short sidewalls to form a shallow receptacle and having an opening at the upper portion of the front wall to receive letter sized documents for filing, said receptacles being located in a staggered stacked relation upon said support means with the back wall of a first receptacle abutting the locating means and the front wall of the first receptacle abutting the back wall of the second receptacle in the stack and with the front and back walls of other receptacles in said stack correspondingly located, the top of the second receptacle and each succeeding receptacle being located below the top of the first receptacle and each preceding receptacle, each of said receptacles having a first rear support part on the back wall of the receptacle and a second front support part on the front wall, said locating means having a front support part complementing said rear support part of each receptacle and said first receptacle having said rear support part located in said front support part of said locating means, said second receptacle having the rear support part located in the front support part of the first receptacle and each succeeding receptacle of said plurality of receptacles having its rear support part located in the front part of the preceding receptacle, said support means and said receptacles having further support parts engaging and holding the lower ends of the receptacles adjacent the vertical wall to support said receptacles with the upper end located outwardly of the bottom end of each receptacle and thereby locate the interconnected receptacles in a forwardly tilted position to facilitate access to the opening in the front walls.

2. The assembly of claim 1 wherein said rear and front support parts are mechanically interlocking parts, said parts being engageable by lowering of the rear support part into the front support part.

3. In the assembly of claim 2 wherein said wall attachment means includes similar laterally spaced mounting strips having inclined slots and said support parts are located adjacent to the outer sides of the receptacles and include flat edge members which fit into said slots.

4. In the wall filing assembly of claim 1 wherein each of said receptacles is vertically positioned to engage and disengage the support parts and said parts include side edges to laterally align and support the stacked receptacles.

5. In the wall filing assembly of claim 1 wherein said locating means is a wedge-shaped member having a flat back mounting wall secured to said wall attachment means and an upper wall and said front wall connected to said upper wall.

* * * * *